US005765237A

United States Patent [19]

Okamoto et al.

[11] Patent Number: 5,765,237

[45] Date of Patent: Jun. 16, 1998

[54] FLUSH POT ASSEMBLY FOR USER REQUIRING CARE-TAKING

[75] Inventors: Kiyoshi Okamoto, Tokyo; Hironobu Nakayama, 2-31-6 Tadao, Machida-shi, Tokyo, both of Japan

[73] Assignees: Tama Juki Construction Co., Ltd.; Hironobu Nakayama, both of Machida, Japan

[21] Appl. No.: 748,617

[22] Filed: Nov. 13, 1996

[30] Foreign Application Priority Data

Jan. 25, 1996 [JP] Japan ..... 8-030145

[51] Int. Cl.[6] ..... E03D 11/12

[52] U.S. Cl. ..... 4/300; 4/312; 4/DIG. 2

[58] Field of Search ..... 4/300, 307, 312, 4/DIG. 2, 431, 432, 433, 419, 420

[56] References Cited

U.S. PATENT DOCUMENTS

| | | | |
|---|---|---|---|
| 456,678 | 7/1891 | O'Brien | 4/312 |
| 1,186,821 | 6/1916 | Nance | 4/DIG. 2 |
| 2,145,435 | 1/1939 | Smith | 4/DIG. 2 |
| 2,443,214 | 6/1948 | Williams | 4/DIG. 2 |
| 2,678,450 | 5/1954 | Simpson et al. | 4/312 |
| 4,944,047 | 7/1990 | Gagliano | 4/DIG. 2 |

FOREIGN PATENT DOCUMENTS

| | | | |
|---|---|---|---|
| 2-171436 | 7/1990 | Japan | 4/300 |
| 3-158535 | 7/1991 | Japan | 4/300 |

*Primary Examiner*—Charles R. Eloshway

*Attorney, Agent, or Firm*—Wenderoth, Lind & Ponack, L.L.P.

[57] ABSTRACT

A flush pot assembly having a pot which is concealed when it is not being used. The pot can be easily accessed for use and washed with washing water after use even by a disabled person or a hospital patient. The flush pot assembly includes a pot connected to a flexible drain hose for passing washing water. The pot is provided such that it is integral with a back surface of a door. The door can be opened and closed and constitutes part of one side of a room. The flexible drain hose is connected between the pot and a drain pipe which leads to the outside of the room. The pot is moved into the room by opening the door and is accommodated in a space outside the room by closing the door.

5 Claims, 10 Drawing Sheets

FLUSH POT ASSEMBLY FOR USER REQUIRING CARE-TAKING

BACKGROUND OF THE INVENTION

1. Field of the Invention

This invention relates to a flush pot assembly for users requiring care-taking, which is installed in home, a hospital room or the like inhabited by a disabled person or a patient requiring care-taking such that it is accommodated in an accommodation space outside the room when it is not being used and can be easily accessed.

2. Prior Art

A movable simplified pot which is used by being seated on it for urination and emptying, is conventionally provided in a room inhabited by a disabled person or a patient, who can not easily walk to the toilet.

Where such a pot is provided, it is necessary to wash the pot after use and also provide de-odorizing and ventilation. Besides, the presence of the pot in the room creates problems because the pot is seen by people in the room it is a source of unpleasant odors, it is not a desirable view, and it limits the effective space utility of the room.

SUMMARY OF THE INVENTION

A first object of the present invention is to provide a pot, which is accommodated and concealed in an accommodation space outside the room when it is not used and can be easily accessed by a disabled person or patient as well as the care-taker when it is to be used, thus suppressing undesired odor as much as possible and maintaining a clean and sanitary environment even in the room, in which the pot is used by the disabled person or patient.

A second object of the present invention is to provide a pot, which is not present in the room and provides for a broader dwelling space when it is not being used.

A third object of the present invention is to provide a pot assembly, which, unlike the conventional movable simplified pot, employs a flush pot and can minimize the necessary labor of the care-taker.

DETAILED DESCRIPTION OF THE PREFERRED EMBODIMENTS

Preferred embodiments of the invention will now be described with reference to the drawings.

Figure 1:
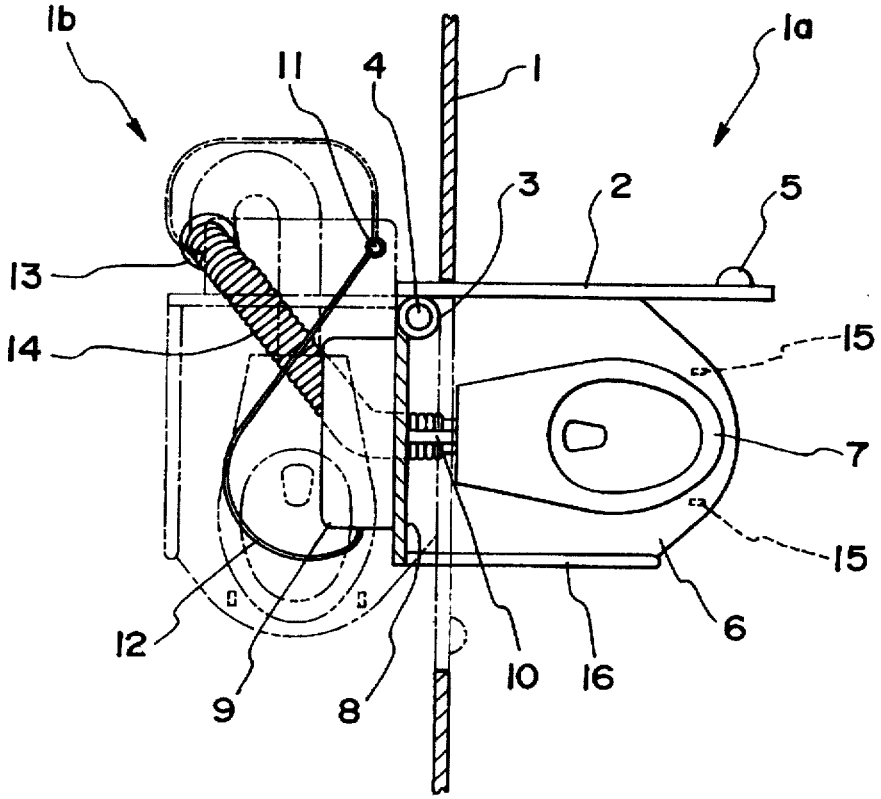
FIG. 1 is a plan view showing a first embodiment of the flush pot assembly according to the invention with a pot in an accessed state.
Figure 2:
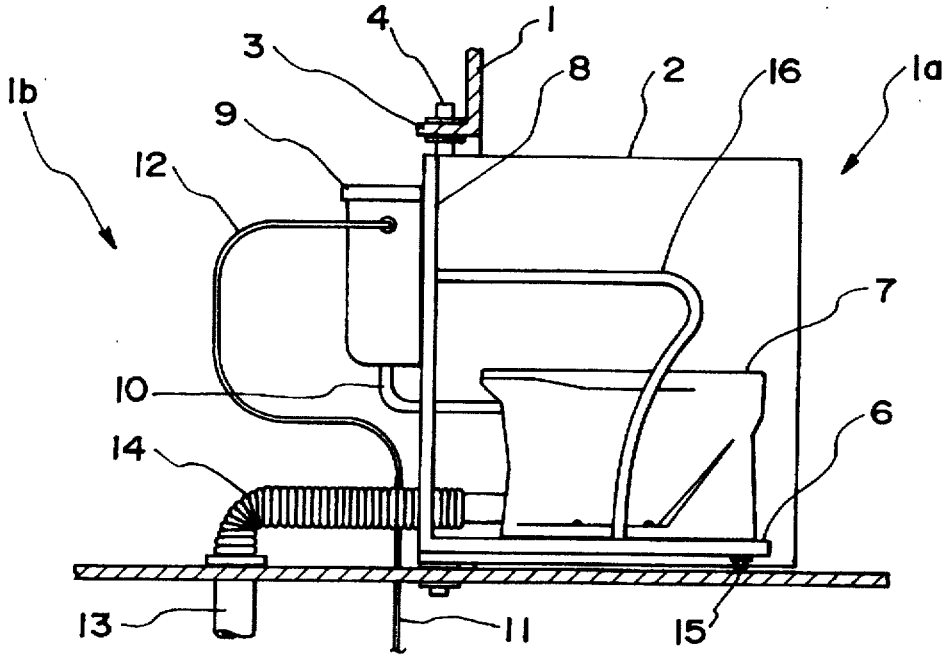
FIG. 2 is a side view showing the flush pot assembly shown in FIG. 1.

FIGS. 1 and 2 show a first embodiment of the flush pot assembly according to the invention. Reference numeral 1 designates the wall of a room in a home, a hospital, etc. which is inhabited by a disabled person or a patient requiring care-taking. Referring to FIG. 1, on the right side of the wall 1 is the room 1*a* inhabited by the disabled person or patient. On the left side of the wall 1 is a closet, a toilet, a separate room, etc. which serves as a pot accommodation or storage space 1*b* which receives the flush pot assembly when it is not being used. Reference numeral 2 designates a door, which constitutes part of the wall 1. The door 2 is rotatable about its fulcrum or hinge, which is supported in a bearing 3 provided in the wall 1. The door 2 has a knob 5.

The door 2 carries a horizontal base 6 with a pot 7 provided thereon.

Reference numeral 8 designates a back plate which is provided on the back side of the pot 7 and is coupled to the door 2 and also to the base 6. The back plate 8 has a washing water tank 9 provided on its back side for accommodating washing water. Washing water can be supplied from the washing water tank 9 through a washing water supply pipe 10 to the pot 7.

Reference numeral 11 denotes a water supply pipe. A flexible water supply hose 12, for instance a rubber hose, is connected between the water supply pipe 11 and the washing water tank 9.

Reference numeral 13 denotes a drain pipe leading to the outside. A bellows-like flexible drain hose 14 is connected between the draining pipe 13 and the pot 7.

Reference numeral 15 designates casters mounted on the underside of the base 6. The casters 15 can roll over the floor to facilitate the movement of the pot 7.

Reference numeral 16 is a grip, which can be gripped by the person using the pot 7 when seating thereon or standing up. The grip 16 is mounted on the back plate 8.

The flush pot assembly of the first embodiment is used as follows. For accessing the pot 7 from the accommodated state in the accommodation space 1*b* as shown by the phantom lines in FIG. 1 into the room 1*a*, the grip 5 of the door 2 is pulled. The door 2 is thus turned about its right side fulcrum and opened, whereby the pot 7 is brought into the room 1*a*. The movement of the pot 7 causes bending, extension or contraction of the flexible water supply hose 12 and the flexible draining hose 14. This gives rise to no trouble because the two hoses are both flexible.

After use, the pot 7 is washed with washing water discharged from the washing water tank 9 by operating a lever (not shown). Thereafter, the door 2 is closed by pushing it, thus returning the pot 7 to the initial position thereof outside the room 1*a*.

Figure 3:
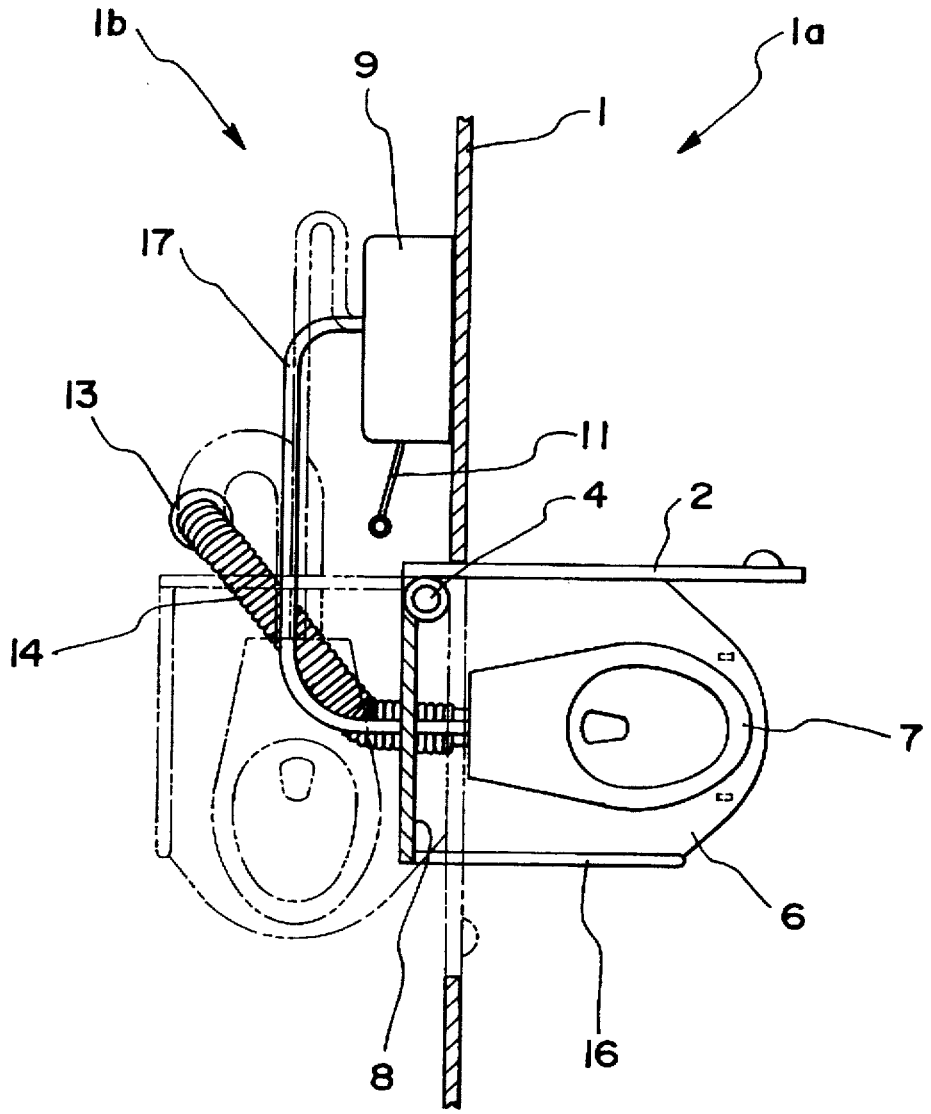
FIG. 3 is a plan view showing a second embodiment of the flush pot assembly according to the invention with a pot in an accessed state.
Figure 4:
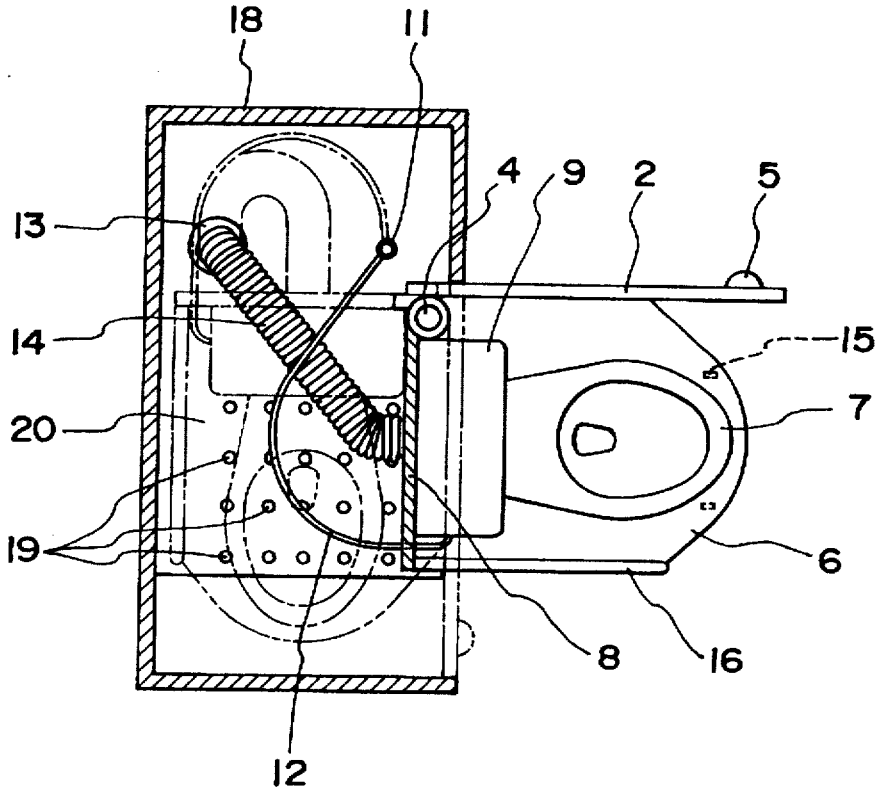
FIG. 4 is a plan view, partly in section, showing a third embodiment of the flush pot assembly according to the invention with a pot in an accessed state.
Figure 5:
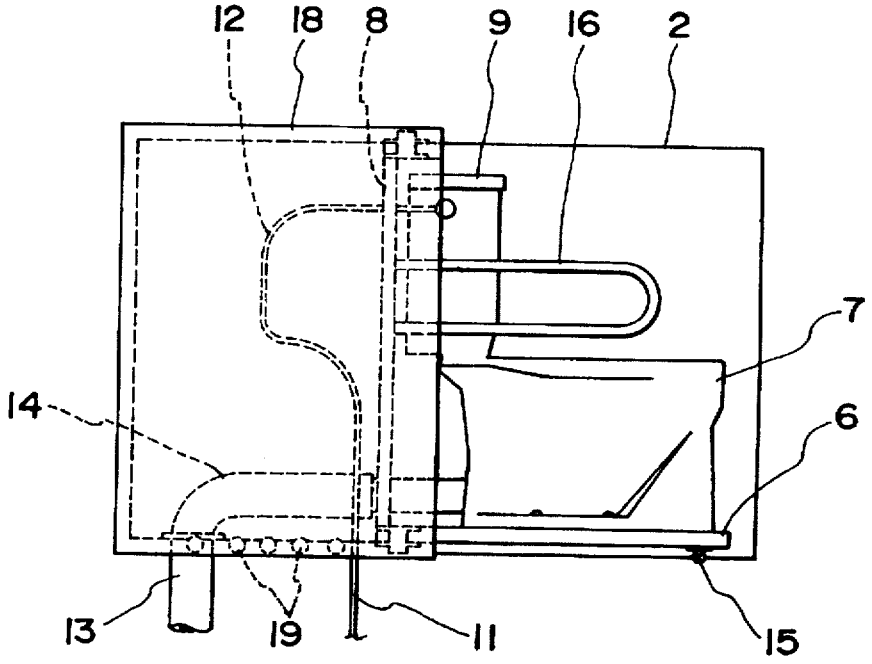
FIG. 5 is a side view showing the flush pot assembly shown in FIG. 4.
Figure 6:
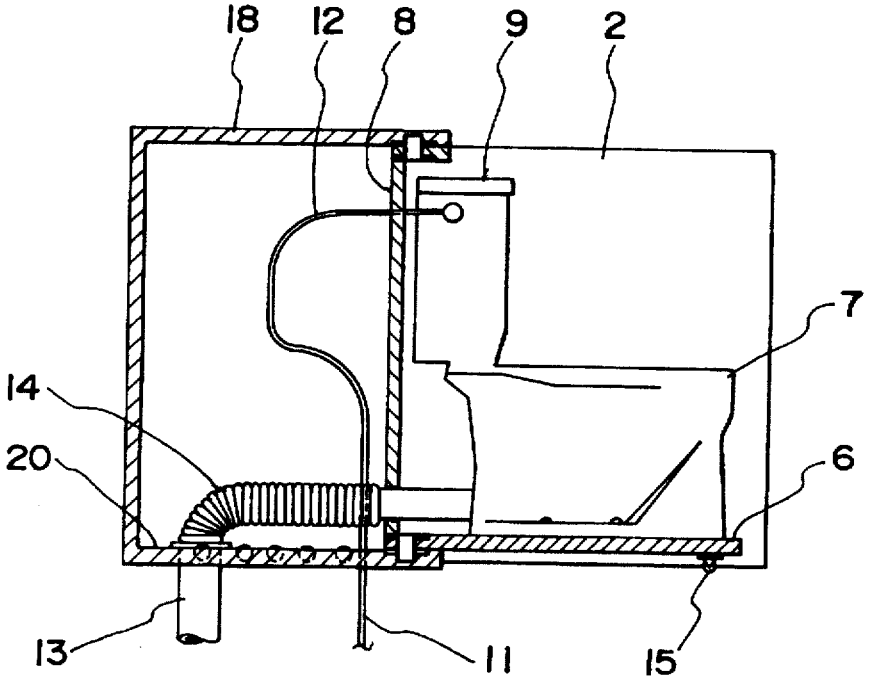
FIG. 6 is a side view, partly in section, showing the flush pot assembly shown in FIG. 4.
Figure 7:
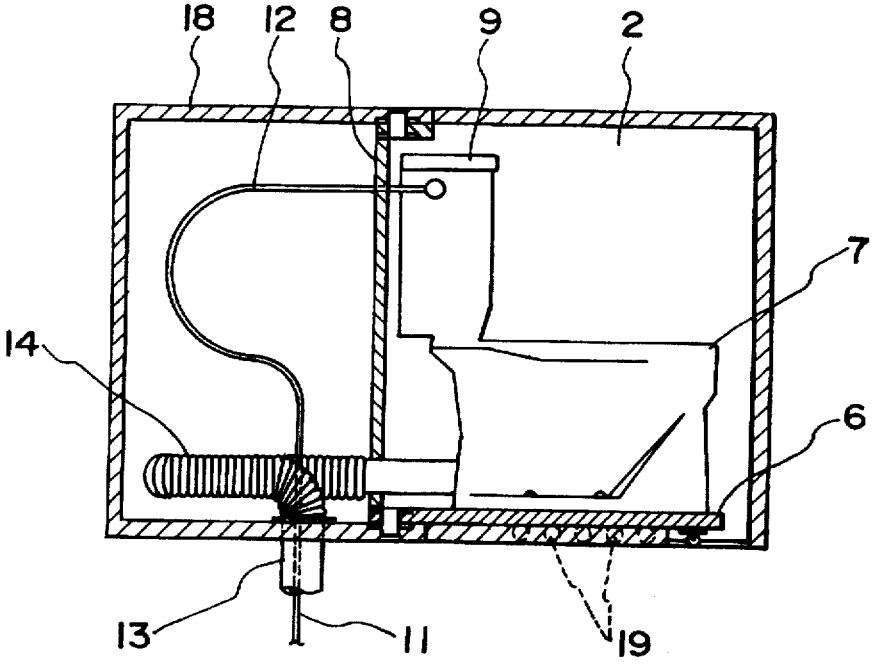
FIG. 7 is a sectional view showing the third embodiment of the flush pot assembly with the pot in an accommodated state.

FIG. 3 shows a second embodiment of the invention. In this flush pot assembly, the washing water tank 9 is provided on the back surface of the wall 1, and a flexible water supply hose 17 is connected between the washing water tank 9 and the pot 7. The water supply pipe 11 is directly secured to the washing water tank 9. The bellows-like flexible draining hose 14 is connected between the draining pipe 13 and the pot 7.

The pot 7 is brought into the room 1*a* by opening the door 2 and is returned to the pot accommodation space 1*b* by closing the door 2. The movement of the pot 7 causes bending, extension or contraction of the flexible water supply hose 17 and the flexible draining hose 14. However, this causes no trouble because the two hoses are both flexible.

FIGS. 4 to 7 show a third embodiment of the invention. Reference numeral 18 designates a pot accommodation box for accommodating the flush pot. The pot accommodation box 18 may be provided in a room or installed in a closet or the like. The door 2 can rotatably open and close a front opening of the pot accommodation box 18. A washing water tank 9 is provided such that it is integral with the top of the pot 7. A suitable number of ball bearings 19 are embedded in the bottom 20 of the pot accommodation box 18 to ensure ready and smooth movement of the base 6 in the pot accommodation box 18. Where the upper surface of the bottom 20 is smooth, no ball bearing may be necessary. The grip 16 for helping the user is mounted on the back plate 8.

The water supply hose 12, for instance a rubber hose, is connected between the water supply pipe 11 and the washing water tank 9. The bellows-like draining hose 14 is connected between the draining pipe 13 and the pot 7.

The pot 7 is taken out of the pot accommodation box 18 by opening the door 2 and accommodated therein by closing the door 2.

The movement of the pot 7 causes bending, extension and contraction of the flexible water supply hose 12 and the flexible draining hose 14, but this gives rise to no trouble because these two hoses are both flexible.

Figure 8:
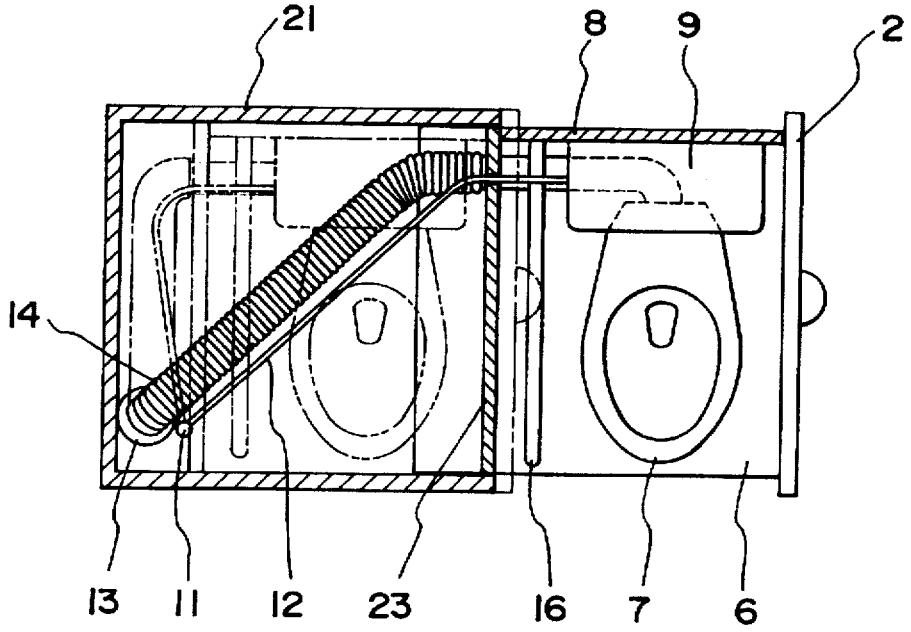
FIG. 8 is a plan view, partly in section, showing a fourth embodiment of the flush pot assembly according to the invention with a pot in an accessed state.
Figure 9:
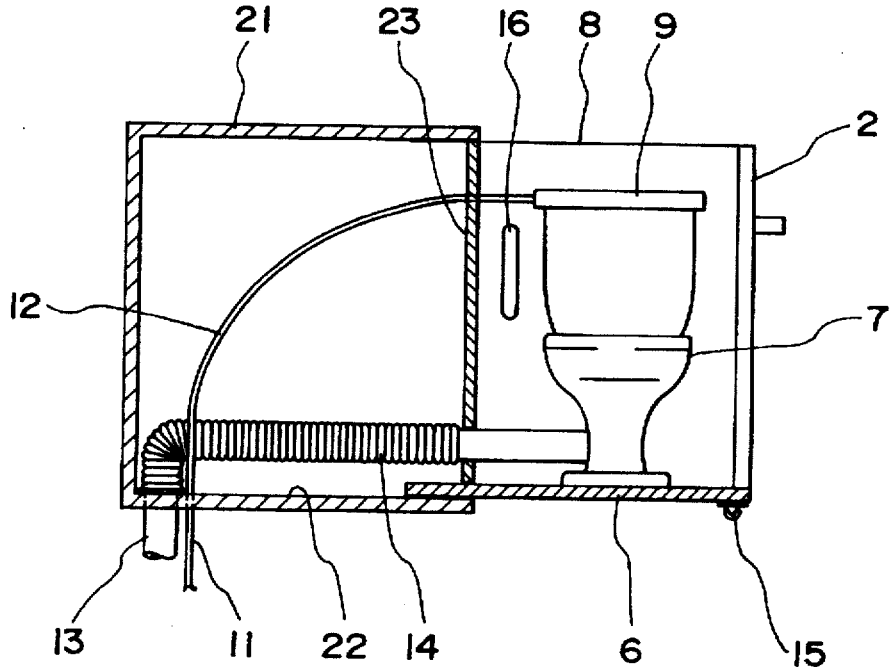
FIG. 9 is a side view, partly in section, showing the fourth embodiment of the flush pot assembly.

FIGS. 8 and 9 show a fourth embodiment of the invention. Reference numeral 21 designates a pot accommodation box. The door 2 is provided at the front of the pot accommodation box 21, and the door carries the base 6 with the pot 7 provided thereon. The base 6 extends horizontally rearwardly from the lower end of the door 2, and it is capable of forward and rearward sliding over the bottom 22 of the pot accommodation box 21. Like the preceding third embodiment, this pot accommodation box 21 may be provided in a room or installed in a closet or the like with the door 2 exposed to a room.

On the back of the pot 7, a side plate 8 extends upright from the base 6, and the grip 16 for helping the user is mounted on the side plate 8. Casters 15 are mounted on the underside of the front end of the base 6, and can roll over the floor. Reference numeral 23 designates a partitioning wall, which partitions the inside of the pot accommodation box 21 with respect to the pot 7.

The flexible water supply hose 12, for instance a rubber hose, is connected between the water supply pipe 11 and the washing water tank 9, and the bellows-like flexible draining hose 14 is connected between the draining pipe 13 and the pot 7.

By pulling the door 2 toward the front, the pot accommodation box 21 is opened, and the pot 7 is taken out. The pot 7 is accommodated in the pot accommodation box 21 by pushing the door 2 toward the pot accommodation box 21. The movement of the pot 7 causes bending, extension or contraction of the flexible water supply hose 12 and the flexible draining hose 14, but this gives rise to no trouble because the two hoses are both flexible.

Figure 10:
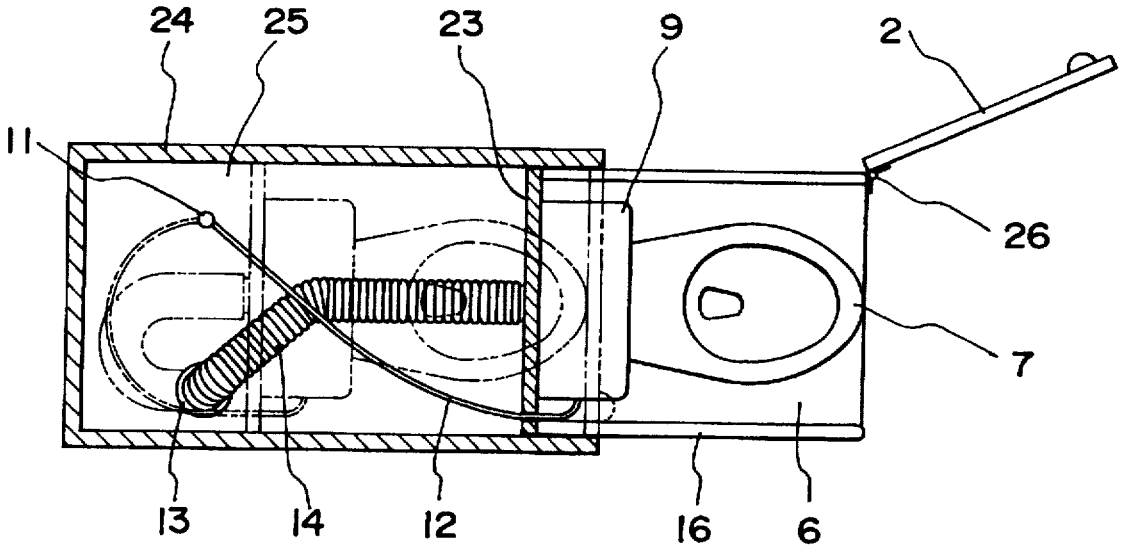
FIG. 10 is a plan view, partly in section, showing a fifth embodiment of the flush pot assembly according to the invention with a pot in an accessed state.
Figure 11:
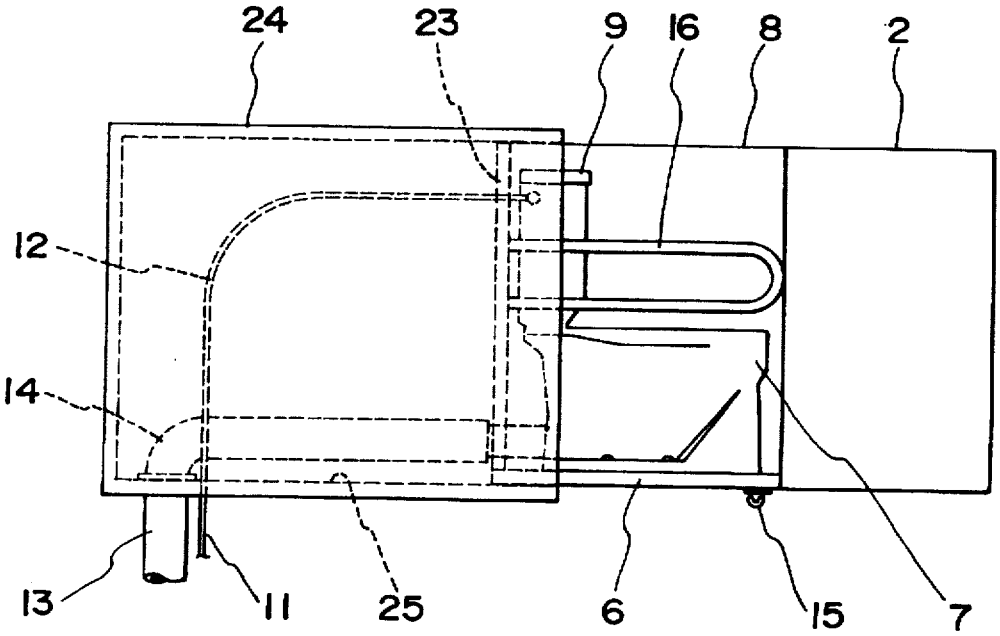
FIG. 11 is a side view showing the fifth embodiment of the flush pot assembly with the pot in the accessed state.
Figure 12:
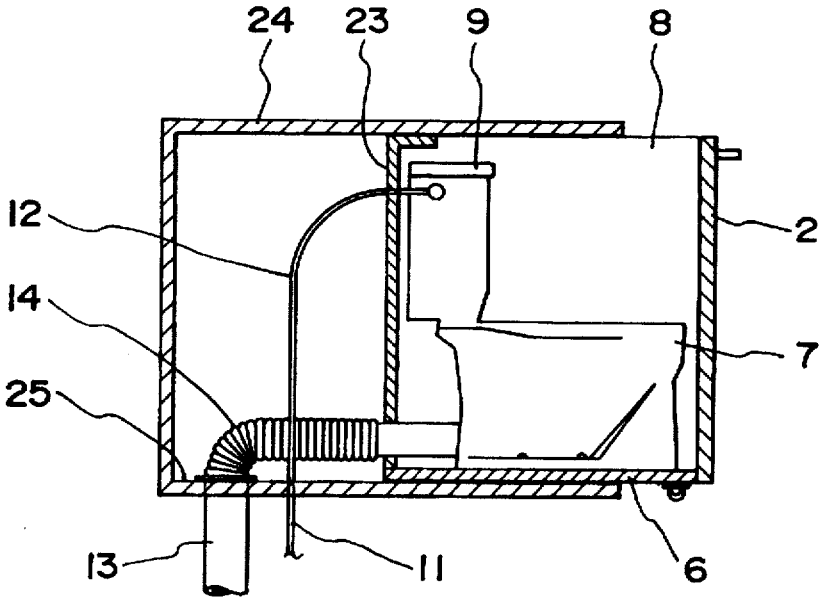
FIG. 12 is a side view, partly in section, showing the fifth embodiment of the flush pot assembly when the pot is being accommodated.

FIGS. 10 to 12 show a fifth embodiment of the invention. Reference numeral 24 designates a pot accommodation box. The door 2 is provided in front of the pot accommodation box 24, and it carries the base 6 with the pot 7 provided thereon and directed toward it. The base 6 extends horizontally from a lower end of a side plate 8 and is capable of forward and rearward sliding over the bottom of the pot accommodation box 25. The door 2 normally closes the front side of the pot 7 and constitutes an obstacle when the pot 7 is used. Accordingly, the door 2 is hinged by a hinge 26 to the side plate 8 so that it can open the front side of the pot 7.

The casters 15 are mounted on the underside of front end of the base 6 and can roll over the floor. The partitioning wall 23 partitions the inside of the pot accommodation box 24 from the side of the pot 7, and the grip 16 for helping the user is mounted on the partitioning wall 23.

The flexible water supply hose 12, for instance a rubber hose, is connected between the water supply pipe 11 and the washing water tank 9, and the bellows-like flexible draining hose 14 is connected between the draining pipe 13 and the pot 7.

By opening the door 2 toward the front and pulling out the pot 7 together with the door 2 and the base 6, the flush pot assembly is made ready for use. By closing the door 2 and pushing the pot 7 into the pot accommodation box 24, the pot 7 is accommodated, and the pot accommodation box 24 is closed. The movement of the pot 7 causes bending, extension or contraction of the flexible water supply hose 12 and the flexible draining hose 14, however this gives rise to no trouble because the two hoses are both flexible.

Figure 13:
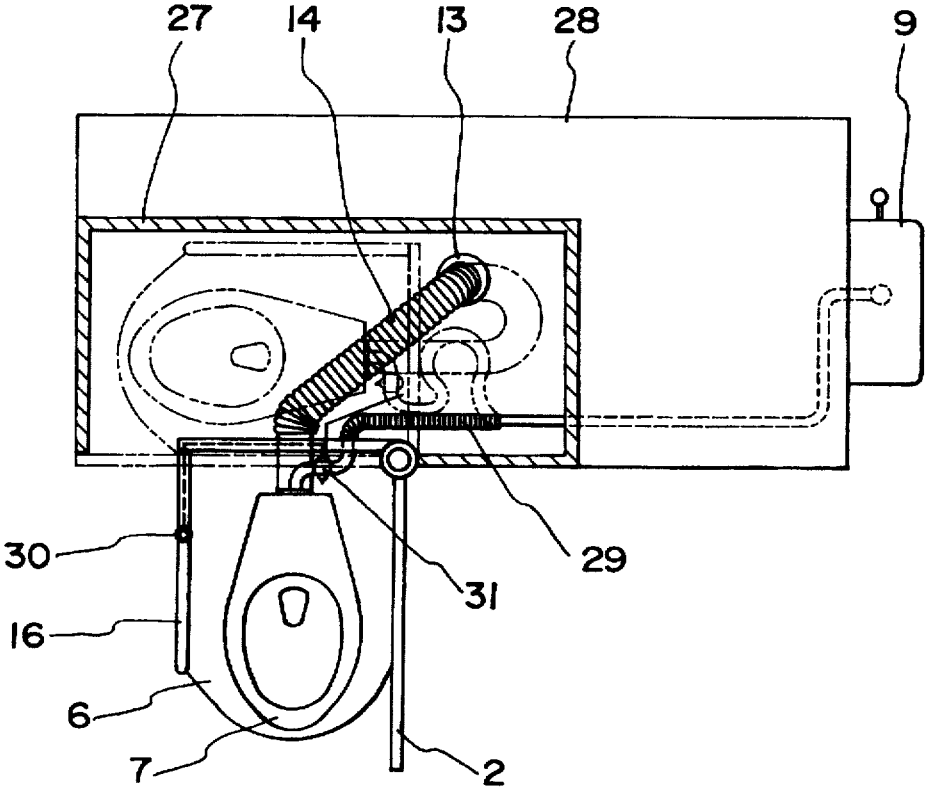
FIG. 13 is a plan view, partly in section, showing a sixth embodiment of the flush pot assembly according to the invention with a pot in an accessed state.
Figure 14:
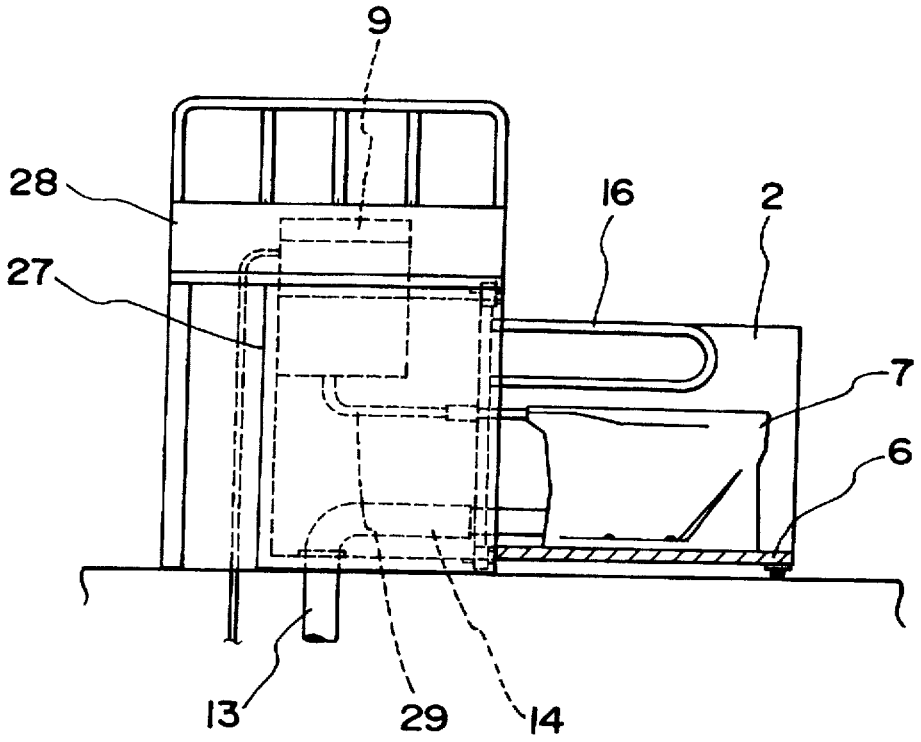
FIG. 14 is a side view showing the sixth embodiment of the flush pot assembly with the pot in the accessed state.

FIGS. 13 and 14 show a sixth embodiment of the invention. Reference numeral 27 designates a pot accommodation box, which is sized such that it can be installed under a bed 28. Like the previous third embodiment, the door 2 is pivoted to a side wall of the frame of the bed 28 with the pot accommodation box 27 installed under the top member of the bed frame. The washing water tank 9 is provided on a wall of the bed frame outside the pot accommodation box 27. A bellows-like flexible water supply hose 29 is connected between the washing water tank 9 and the pot 7 and on the side thereof.

Reference numeral 30 designates a switch provided on the grip 16. By operating the switch 30, an electromagnetic valve 31 provided on the water supply hose 29 is opened, causing washing water to flow from the washing water tank 9 into the pot 7. The bellows-like flexible draining hose 14 is connected between the draining pipe 13 and the pot 7.

When the pot 7 is removed from and put into the pot accommodation box 27 by opening and closing the door 2, the flexible water supply hose 29 and the flexible draining hose 14 are bent, extended or contracted, but this gives rise to no problem because the two hoses are both flexible.

Figure 15:
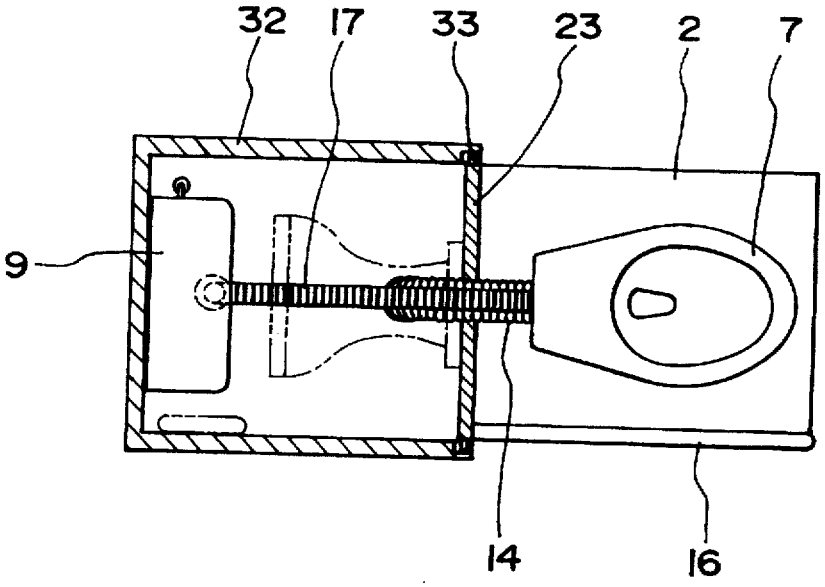
FIG. 15 is a plan view, partly in section, showing a seventh embodiment of the flush pot assembly according to the invention with a pot in an accessed state.
Figure 16:
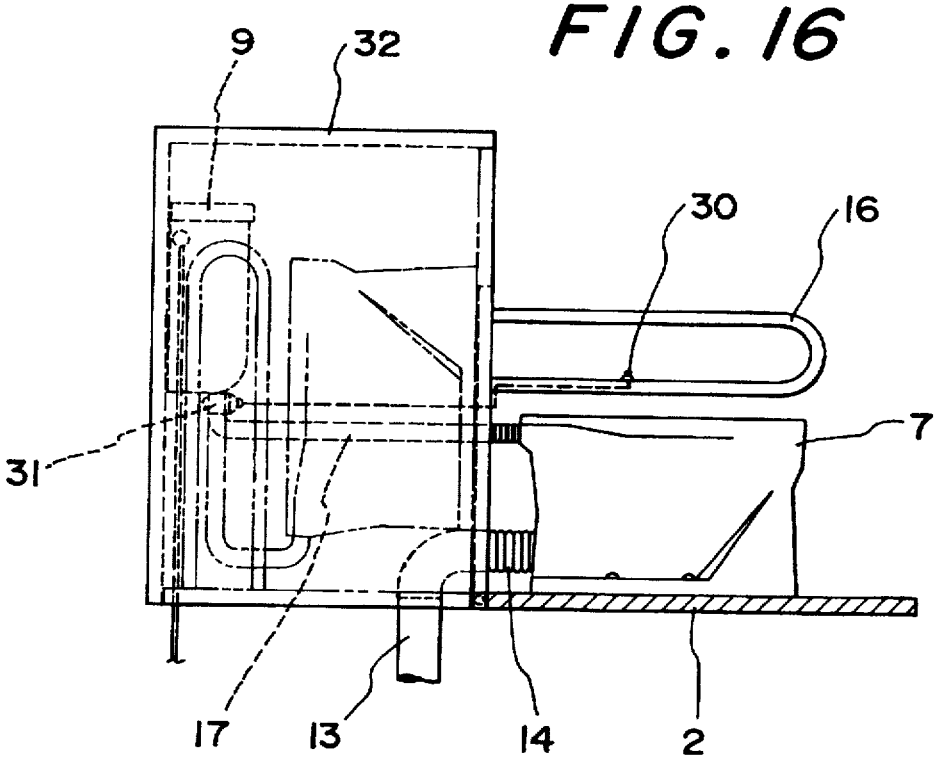
FIG. 16 is a side view showing the seventh embodiment of the flush pot assembly with the pot in the accessed state.
Figure 17:
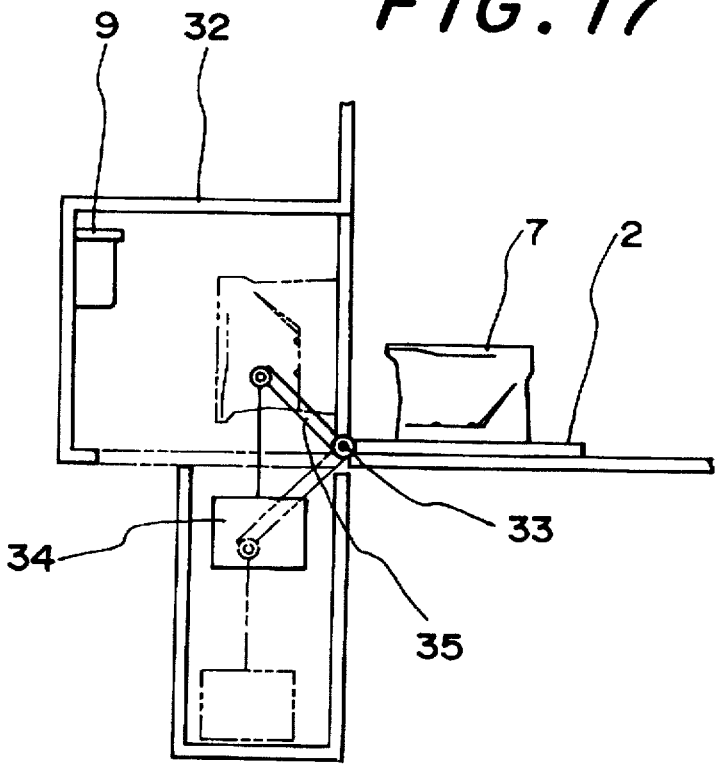
FIG. 17 is a view illustrating the seventh embodiment of the flush pot assembly with the provision of a balance weight.

FIGS. 15 to 17 show a seventh embodiment of the invention. Reference numeral 32 in these Figures designates a pot accommodation box. The door 2 is pivotally provided in front of the pot accommodation box 32 and pivotally supported by a shaft 33 provided at the lower end of the pot accommodation box 32. In its closed state the door 2 extends upright from the floor, and in its open state it is horizontal and in close contact with the floor. The pot 7 is integral with the back surface of the door 2, so that it can be used in the open state of the door 2. An upright partitioning wall 23 partitions the inside of the pot accommodation box 32 with respect to the side of the pot 7, and the grip 16 is mounted on the partitioning wall 23.

The washing water tank 9 is mounted on an inner wall surface of the pot accommodation box 32, and a bellows-like flexible water supply hose 17 is connected between the water washing tank 9 and the pot 7. By operating the switch 30 provided on the grip 16, the electromagnetic valve 31 provided on the water supply hose 17 is opened to cause washing water to flow from the washing water tank 9 into the tank 7.

After it has been used, the pot 7 can be accommodated in the pot accommodation box 32 by turning it about the shaft 33 such as to raise it. By so doing, the front of the pot accommodation box 32 is closed by the door 2.

Reference numeral 34 in FIG. 17 designates a balance weight which may be provided, if necessary, underneath the floor to facilitate the operation of turning the door 2 and the pot 7. The balance weight has a stem suspended from a shaft arm 35 which is integral with the shaft 33 supporting the door.

Figure 18:
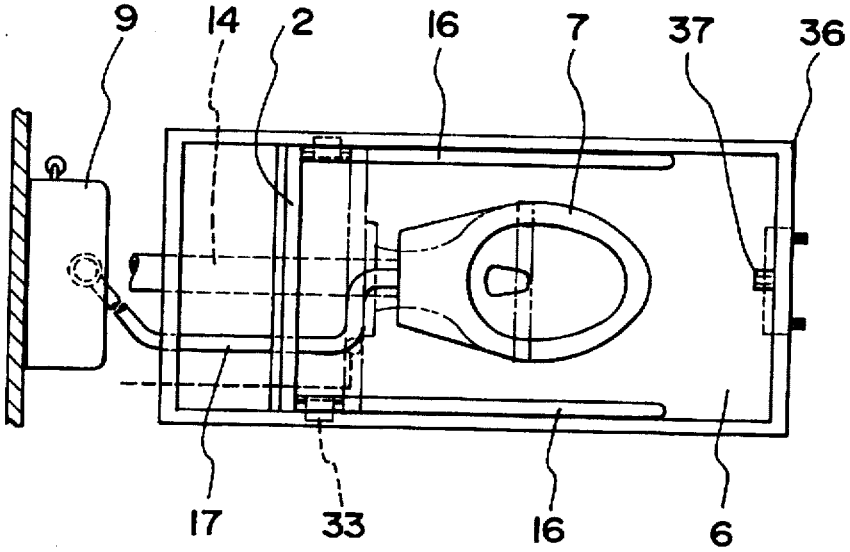
FIG. 18 is a plan view, partly in section, showing an eighth embodiment of the flush pot assembly with a pot in an accessed state.
Figure 19:
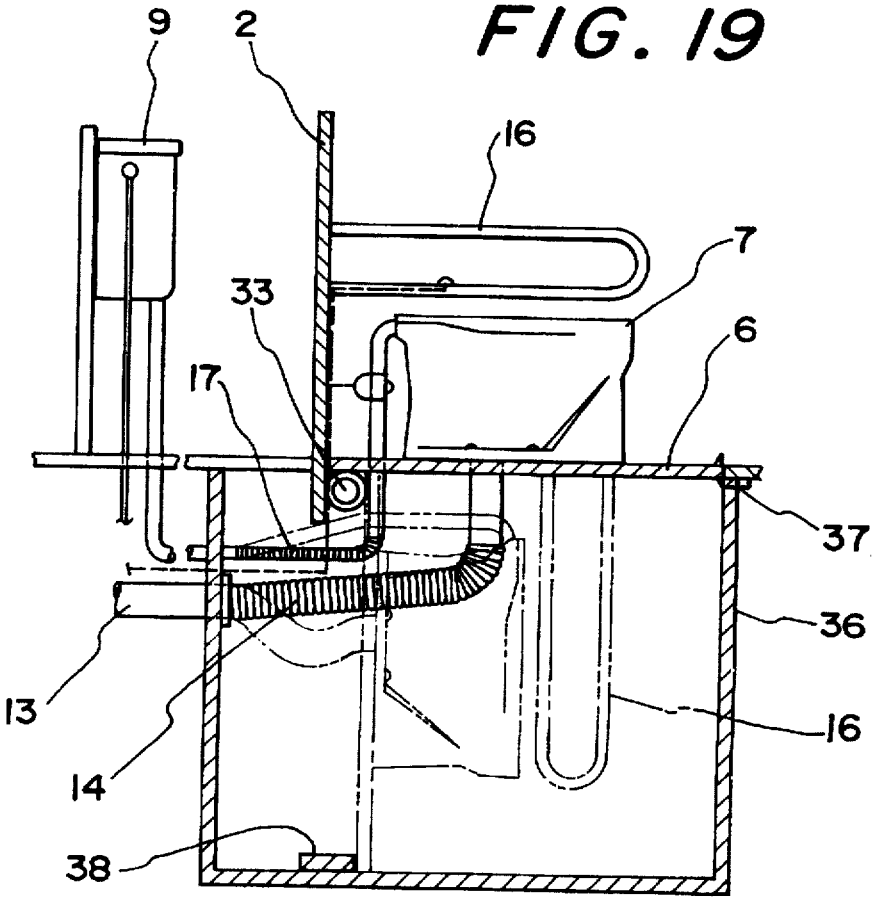
FIG. 19 is a side view, partly in section, showing the eighth embodiment of the flush pot assembly with the pot in the accessed state.

FIGS. 18 and 19 show an eighth embodiment of the invention. Reference numeral 36 in these Figures designates a pot accommodation box which is installed under the floor. The door 2 is mounted on the rear end of the base 6 with the pot 7 provided thereon such that it is perpendicular to the base 6. In its closed state, the door 2 closes the top of the pot accommodation box 36 and constitutes part of the floor. The door is opened by turning it about the shaft 33 so as to be perpendicular to the floor. The base 6 is supported by the shaft 33 which is provided on the floor, and can be turned in unison with the door 2.

In the closed state of the door 2, the pot 7 and the base 6 are accommodated in the pot accommodation box 36. In the open state of the door 2, the base 6 is held horizontally at the top of the pot accommodation box 36, and the pot 7 is ready for use. Reference numeral 37 designates a stopper for holding the base 6 in the horizontal state. Reference numeral 38 is a stopper for holding the base 6 in an accommodated position.

A bellows-like, partly flexible water supply hose 17 is connected between the washing water tank 9 which is secured to the floor and the pot 7, so that washing water can be supplied from the washing water tank 9 to the pot 7.

The bellows-like flexible draining hose 14 is connected between the draining pipe 14 which extends underneath the floor and the pot 7.

After it has been used, the pot 7 can be returned to the pot accommodation box 36 by detaching the stopper 37 from the base 6 and downwardly turning it about the shaft 33. At this time, the top of the pot accommodation box 36 is closed by the door 2.

By installing the flush pot assembly having the construction as described above according to the invention in a closet or the like of a room in home or a hospital room, which is inhabited by a disabled person or a patient requiring care-taking, the pot which is accommodated in the space outside the room when it is not used, can be easily accessed for use by the disabled person or the patient as well as the care-taker. Besides, the pot is not present in the room when it is not used, thus providing for a broader dwelling space. Further, undesired odor in the room can be reduced to reduce the necessity of ventilation or the like, and a clean and sanitary environment can be maintained in the room.

The flush pot assembly according to the invention also can be used commonly in two adjacent rooms in a home or a hospital, one of which is inhabited by a disabled person or a patient requiring care-taking, by installing it in a space between the two rooms. It is further possible to use the flush pot assembly commonly in a usual toilette in home or in a hospital and a room, which is inhabited by a disabled person or a patient requiring care-talking, by installing it in the wall between the toilette and the room.

With the pot of the flush pot assembly according to the invention accommodation, it is possible to install the assembly in a closet or the like of a room without the need to greatly modify the room.

Since the pot itself is the flush pot, manual washing of the pot, de-odorizing or ventillation is substantially unnecessary, thus substantially reducing the necessary labor of the care-taker.

Moreover, the flush pot assembly according to the invention can be utilized as a portable flush pot assembly so long as the place where it is to be used is provided with a supply of water and draining equipment.

What is claimed is:

1. A flush pot assembly for individuals requiring caretaking, said flush pot assembly comprising:

a door adapted to be movably mounted in an opening formed in a wall of a room, wherein said door constitutes a portion of the room wall when mounted in the wall opening;

a pot integrally connected to a back side of said door such that said pot is moveable with said door;

a water tank integrally connected to said back side of said door such that said water tank is moveable with said door, said water tank being in fluid communication with said pot;

a flexible water supply hose fluidly connected to said water tank for delivering water to said water tank from a water supply; and a flexible drain hose fluidly connected to said pot, wherein said pot is moved to a use position on a first side of the room wall when said door is moved to an open position, said pot is moved to a storage position on a second side of the room wall when said door is moved to a closed position, and said water tank remains on the second side of the room wall in both the open and closed positions of said door.

2. The flush pot assembly as claimed in claim 1, further comprising a base extending horizontally from a lower portion of said door, wherein said pot is directly mounted on said base.

3. The flush pot assembly as claimed in claim 2, further comprising a vertical back plate extending perpendicularly from said back side of said door and connected to a peripheral edge portion of said base, wherein said water tank is mounted on said back plate.

4. The flush pot assembly as claimed in claim 3, further comprising a gripping bar having a first end and a second end, wherein said first end is connected to said back plate and said second end is connected to said base.

5. The flush pot assembly as claimed in claim 2, further comprising a plurality of casters mounted on a bottom surface of said base.

* * * * *